United States Patent [19]

Hubert

[11] 4,048,933

[45] Sept. 20, 1977

[54] CONTAINER HEAD FORMING

[75] Inventor: Warren N. Hubert, Duncanville, Tex.

[73] Assignee: Dixico Inc., Dallas, Tex.

[21] Appl. No.: 673,444

[22] Filed: Apr. 5, 1976

[51] Int. Cl.[2] ..... B21D 51/36; B21D 37/06

[52] U.S. Cl. ..... 113/1 B; 113/120 D

[58] Field of Search ..... 113/1 B, 1 G, 120 R, 113/120 D, 120 M, 120 XY, 120 Z, 120 H, 120 AA, 116 DD; 72/402, 403, 367, 370, 469

[56] References Cited

U.S. PATENT DOCUMENTS

| | | | |
|---|---|---|---|
| 1,746,869 | 2/1930 | Rosenthal | 113/120 M |
| 1,990,560 | 2/1935 | Mock | 113/120 D |
| 2,001,760 | 5/1935 | Barker | 113/1 B |
| 2,311,663 | 2/1943 | Hunziker | 72/402 |
| 3,292,414 | 12/1966 | Goeke | 72/402 |
| 3,695,087 | 10/1972 | Tuberman | 72/402 |
| 3,952,676 | 4/1976 | Rockefeller | 113/1 B |

FOREIGN PATENT DOCUMENTS

| | | | |
|---|---|---|---|
| 78,541 | 12/1970 | Germany | 72/402 |
| 1,211,576 | 3/1966 | Germany | 72/402 |
| 35,966 | 7/1935 | Netherlands | 113/120 H |

*Primary Examiner*—Michael J. Keenan

*Attorney, Agent, or Firm*—McAulay, Fields, Fisher & Goldstein

[57] ABSTRACT

One end of a collapsible cylinder having an impermeable side wall is shaped to form an impermeable shoulder and neck liner on which a polyethylene head can be molded. The end of the collapsible cylinder is crimped by a plurality of arms which are swung down simultaneously to form the end of the cylinder into a plurality of pleats, each pleat having a shoulder portion and a neck portion. Each arm carries a prism like member which creases and partially folds over the pleats. This crimped cylinder is then removed to another location where a shoulder forming block descends axially on it to form the shoulder including a re-entrant edge at the outer periphery of the shoulder. A series of truncated, pie-shaped blocks are brought in radially to contact the pleats and complete the folding over of the pleats. The intermediate product thus formed is ready to have the plastic head molded onto it.

6 Claims, 15 Drawing Figures

22
29
28
32
32n
34
32s

CONTAINER HEAD FORMING

BACKGROUND OF THE INVENTION

This invention relates to a technique for forming the shoulder and neck of a squeeze tube such as the type used for toothpaste. More particularly, this invention involves a technique for forming the inner wall of the shoulder and neck from an upward extension of the collapsible sidewall.

The collapsible sidewall of the squeeze tube is cylindrical. The head portion has an inwardly extending shoulder and an upwardly extending substantially cylindrical neck. The neck is threaded to receive a cap.

The shoulder and neck portions are normally molded as a rigid piece of, for example, polyethylene, onto the top of the sidewall. The plastic head frequently requires an impervious insert to prevent oxygen from passing into the container and to prevent flavorants and other constituents of the produce from passing out through the molded head. The sidewall is usually a multi-ply material having at least one metal ply to provide this impervious layer. One multi-ply sidewall arrangement is described in U.S. Pat. No. 3,295,725 issued to R. Brandt on Jan. 3, 1967 and impervious insert arrangements for the head are described in U.S. Pat. Nos. 3,260,411 issued to F. E. Dobson on July 12, 1966 and 3,565,293 issued to R. Schulty on Feb. 23, 1971.

If the sidewall could be extended upward into the head portion of the squeeze tube, that would provide the required impervious layer. However, because the shoulder slopes in and the neck has a diameter less than that of the sidewall, it becomes very difficult to bend and fold and shape the sidewall into a useable shape on which the rigid head could then be molded. Suggestions for so extending the sidewall are shown in U.S. Pat. No. 2,176,109 issued to J. P. Ratay on Apr. 4, 1939. But, such suggestions have not been followed because of the difficulty of forming the shoulder and neck from an extension of the sidewall. Accordingly, it is a major purpose of this invention to provide an apparatus and method for forming a shoulder and neck layer from an upward extension of the sidewall.

It is an important purpose of this invention to provide this impervious layer in a fashion that is both reliable and repeatable so that the head will be reliably impervious and so that the shape formed will be repeated each time the operation is performed on a separate tube.

It is further important that each objective be achieved with a mechanism and through a method that is fast acting and that is economical.

BRIEF DESCRIPTION

In brief, this invention involves the crimping of the upper portion of a collapsible cylinder to provide an intermediate product having an eight pointed starlike upper portion. The crimping machine employs eight arms which pivot down around the upper portion of the collapsible cylinder starting material to form eight pleats. A prism-like element on one side of each arm provides a transverse crease at one side of each of the eight pleats created by the crimping device. This crease provides a bias and a small degree of initial folding which assures that in a later folding operation each of the pleats will fold in the same direction.

After the crimping operation, the pleated intermediate product is transported to a position under a shaping and folding machine. A shoulder shaping annular block descends on the shoulder portion to further shape the crimped intermediate product. Six folding blocks in the folding machine are then moved radially inward to contact the neck portion and complete the folding over of the pleats into a tight fold. Thus a product is formed which is ready to have a rigid shoulder and neck molded on top of the tightly folded over pleats.

THE DRAWINGS

FIG. 12 shows the folding device in position for forming the shoulder shown in FIG. 5.

DESCRIPTION OF THE PREFERRED EMBODIMENTS

Figure 1:
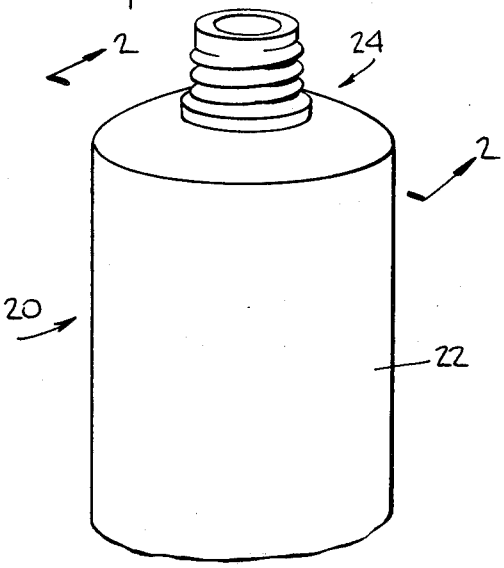
FIG. 1 is a perspective view of the end product of this invention.
Figure 2:
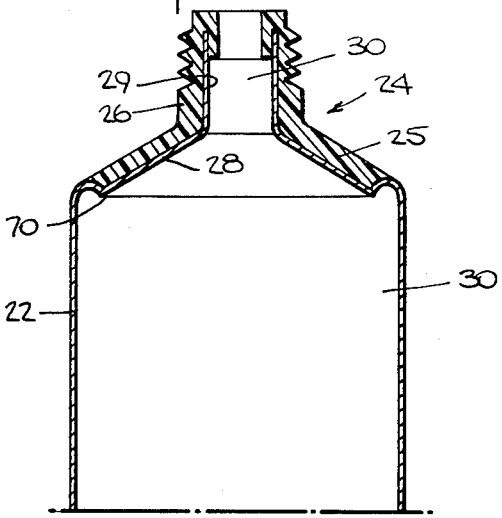
FIG. 2 is a longitudinal sectional view of the FIG. 2 product taken along the line 2—2.

The following description refers to the FIGS. all of which relate to a single embodiment of this invention. As illustrated in FIGS. 1 and 2 the product to which this invention is addressed is in a squeeze tube 20 having a collapsible sidewall 22 and rigid head portion 24. This head 24, which may be molded of polyethylene, has a shoulder 25 and a threaded neck 26. By virtue of the apparatus and technique of this invention, the impermeable sidewall 22 extends up and inward to form a layer between the head 24 and the interior of the container. Specifically, the sidewall 22 includes a shoulder portion 28 which is between the inner surface of the polyethylene shoulder 25 and the interior of the tube. The sidewall 22 also extends further up to provide a neck portion 29 between the polyethylene threaded neck 26 and the interior of the collapsible tube 20.

Figures 3, 4, 5, 6:
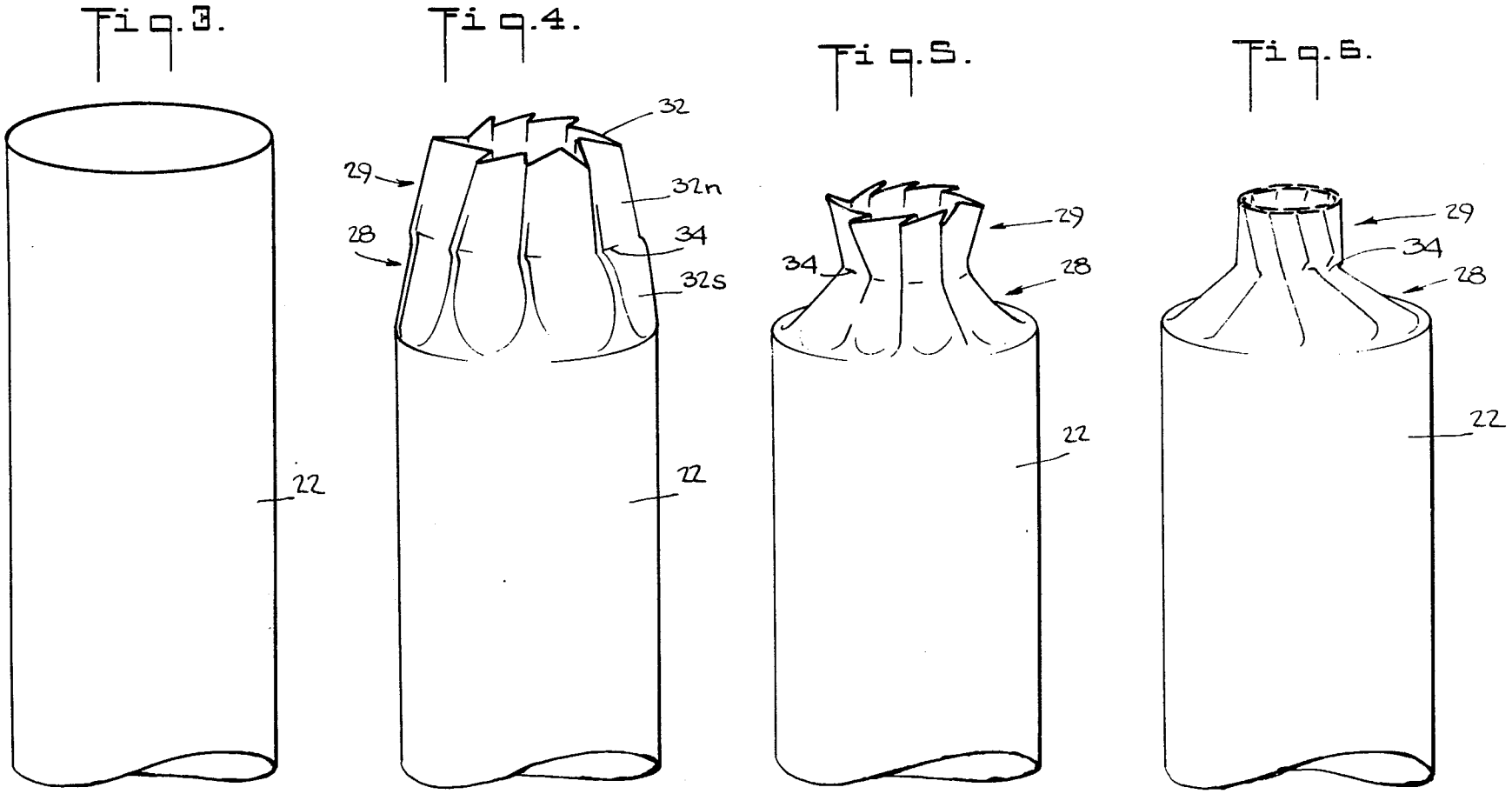
FIG. 3 illustrates the cylindrical starting material which forms the sidewall of the squeeze tube.
FIG. 4 illustrates the intermediate product that is the result of a crimping step to form a set of pleats as the shoulder and neck portions of the upper part of the FIG. 3 cylinder.
FIG. 5 illustrates the intermediate product that is the result of a further step in the forming of the shoulder and further folding over of the pleats.
FIG. 6 illustrates an intermediate product that is the result of a final step in the forming of the shoulder and neck including the folding of the neck and shoulder pleats.
Figure 10:
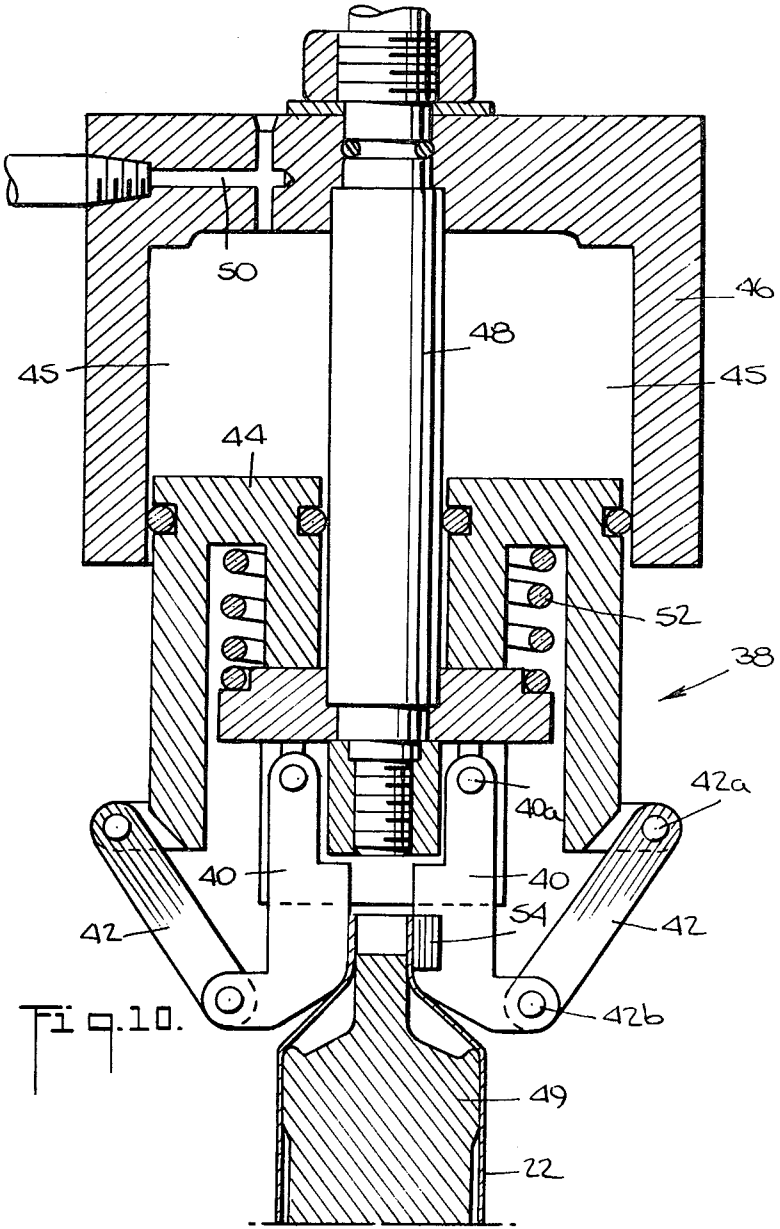
FIG. 10 is a view similar to that of FIG. 9 but at the stage of the crimping machine corresponding to that shown in the FIG. 8 perspective view.
Figure 9:
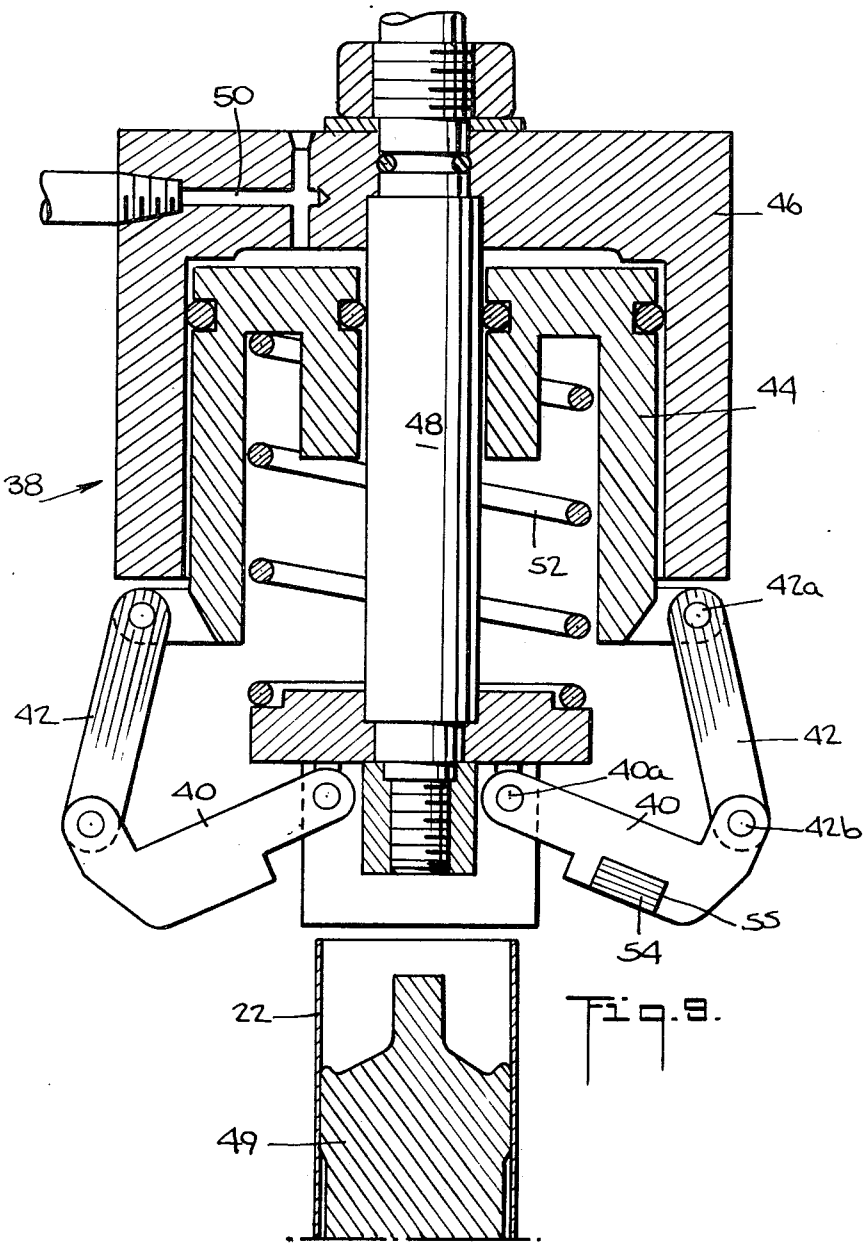
FIG. 9 is a longitudinal sectional view in partial relief of the crimping machine at the stage shown in the FIG. 7 perspective view.

The end product illustrated in FIGS. 1 and 2 is formed by molding the polyethylene head 24 onto an intermediate product having the configuration shown in FIG. 6. The forming of the FIG. 6 intermediate product requires the crimping and folding machinery illustrated in subsequent FIGS. and can best be understood by first appreciating the sequence of configurations formed from the cylinder 22.

The cylinder 22 starts out as a collapsible cylinder as shown in FIG. 3 which cylinder normally is a multi-ply material having a metal foil layer sandwiched between inner and outer plastic layers. This structure is known in the art and therefore is not further discussed herein.

In a first crimping step, the FIG. 4 product is created in which pleats 32 are crimped in the top portion of the cylinder 22. Each crimped pleat 32 has an upper portion 32*n* which will ultimately be in the neck 29 of the end product and a lower portion 32*s* which will ultimately be in the shoulder portion 28 of the end product. In each pleat 32, the line between the upper portion 32*n* and the lower portion 32*s* includes a horizontal crease 34. This crease 34 is a concave crease on the right surface of each pleat 32 and a convex crease on the left surface of each pleat 32. This horizontal crease 34 assures a break between the neck and shoulder and aids in biasing each pleat 32 to fold over in the same rotational direction; clockwise as seen from the top.

After this initial crimping, the shoulder portion 28 is shaped to form the product as shown in FIG. 5. Then the pleats 32 are all tightly folded over in the same rotational direction to form the neck portion 29 and thus provide the intermediate product 36 shown in FIG. 6.

FIGS. 7 through 10 illustrate the crimping machine arrangement of this invention. This crimping machine operates on the collapsible cylinder 22 shown in FIG. 3 to produce the intermediate product shown in FIGS. 4 and 11. The crimping machine 38 has a plurality of arms 40 each one of which rotates in a vertical plane about the point 40*a*. In the embodiment illustrated there are eight arms 40 but only one or two are shown in each of the FIGS. in order to facilitate illustration and understanding. These eight arms 40 are evenly deployed around a vertical axis. A link 42 drives each arm 40 between the angled position shown in FIGS. 7 and 9 and the substantially vertical position shown in FIGS. 8 and 10. The link 42 in turn is driven by a vertically movable annular piston 44. This piston 44 moves within an annular chamber defined by an inverted cup like frame member 46 and a central support shaft 48. The piston 44 is driven into its downward state shown in FIGS. 8 and 10 by admitting air under pressure through passageways 50 into the chamber 45. When the air pressure is relieved, the spring 52 returns the piston 44 to its upper position shown in FIGS. 7 and 9. The link 42 is pivotally mounted to piston 44 at the point 42*a* and is pivotally mounted to arm 40 at the point 42*b*. The arm 40, in turn, is pivotally mounted to the stationery frame at the point 40*a*.

Figure 7:
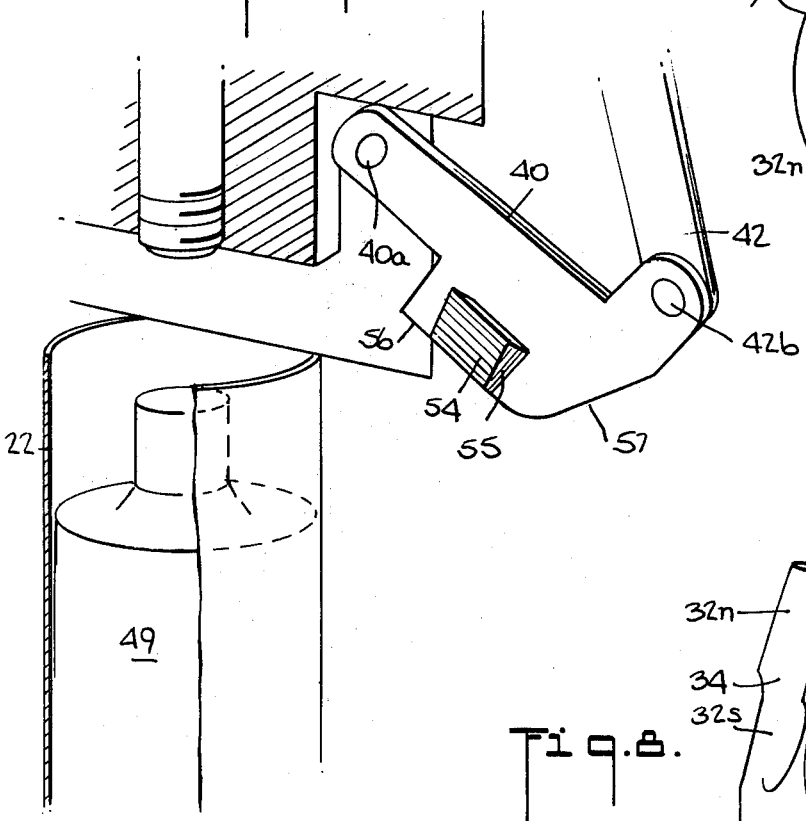
FIG. 7 is a perspective view showing a portion of the crimping device preparatory to engaging the FIG. 3 cylinder. The FIG. 3 cylinder is held on a forming block and no contact has yet been made between the crimping device and the cylinder.
Figure 8:
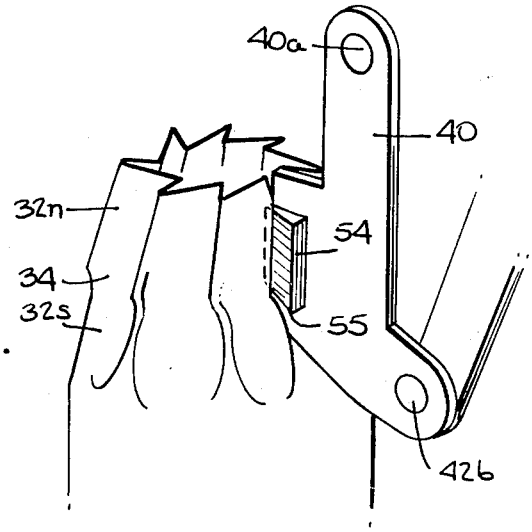
FIG. 8 shows the engagement between one out of eight crimping arms and the collapsible cylinder to form the intermediate product shown in FIG. 4. In operation, at the stage of forming shown in FIG. 8, there would be eight arms but only one is shown to facilitate viewing.

Each arm 40 has a prism shaped member 54 (best seen in FIGS. 7 and 8). The lower edge 55 of this member 54 is substantially horizontal at the advanced end of the stroke of the arm 40. When in this position (as shown in FIG. 8) this lower edge 55 abuts against one surface of the associated pleat 32 to create a horizontal crease on one surface of that pleat 32. The action of the prism 54 causes the associated pleat 32 to fold over slightly creating the condition best seen in FIG. 11. This occurs on each of the pleats 32 since each pleat 32 is created by a separate arm 40 having a separate prism like member 54.

The arm 40 has a first leading edge 56 which is vertical at the advanced end of the stroke of the arm 40 and serves to form the neck portion 32*n* of the pleat 32. The arm 40 also has a second leading edge 57 which, in the advanced position of the arm 40, is at a substantial angle (approximately 45°) to the vertical and serves to initially create the shoulder portion 32*s* of the pleat 32.

During the operation shown in FIGS. 7 through 10, the collapsible cylinder 22 is supported on a support form 49. This support form 49, in turn, is mounted on a turntable, (not shown) so that after the completion of the crimping operation by the crimping machine 38 the form 49 can be rotated out of the way and the next form 49 carrying a cylinder 22 brought into place for the crimping operation.

Figure 11:
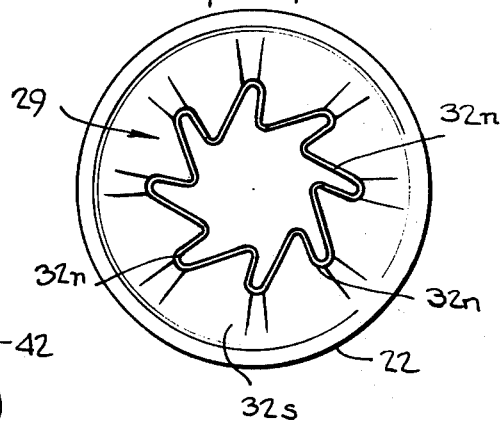
FIG. 11 is a view looking down at the intermediate product illustrated in FIGS. 4 and 8.
Figure 12:
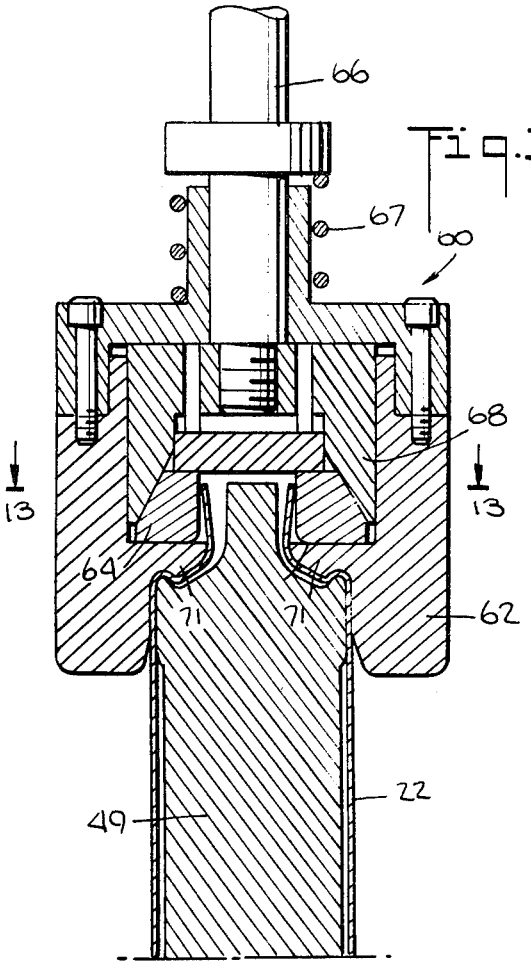
FIG. 12 is a longitudinal sectional view of the shoulder forming and pleat folding device used to form the FIG. 5 and FIG. 6 stage product from the FIG. 4 intermediate product.
Figure 14:
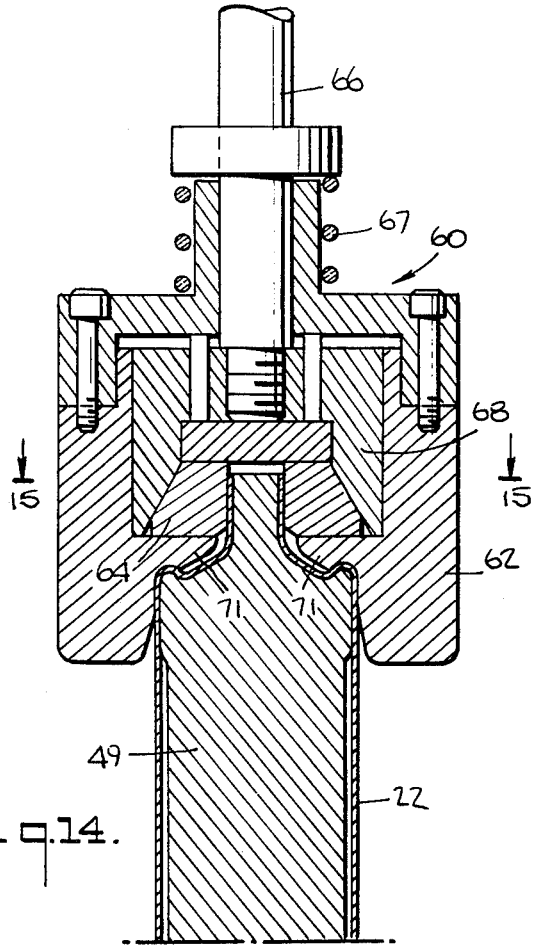
FIG. 14 is a view similar to that of FIG. 12 showing the folding device having completed its operation to fold over the pleats and provide the FIG. 6 product.
Figure 13:
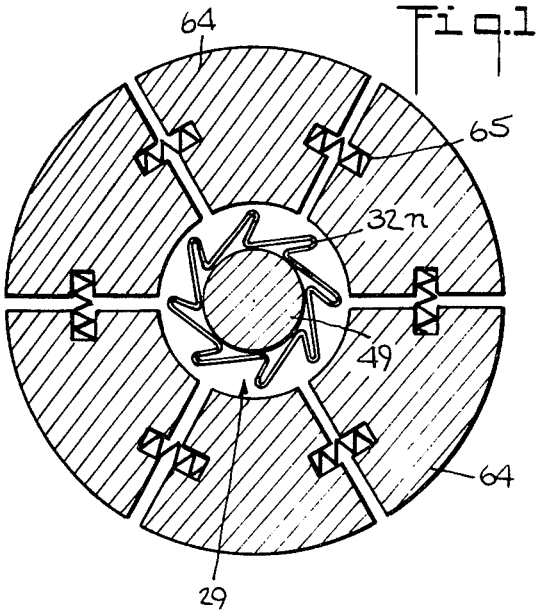
FIG. 13 is a cross-sectional view along the line 13—13 of FIG. 12 illustrating the configuration of the top of the partially formed head at the stage illustrated in FIG. 5 and FIG. 12.

After the crimping operation, the form 49 is rotated to the next work stage at which the now crimped intermediate product having the structure illustrated in FIGS. 4 and 11 is brought under the shoulder forming and folding machine 60 illustrated in FIGS. 12 through 15. When in that position, the folding machine 60 is brought down to the position shown in FIG. 12 in which an annular shoulder forming block 62 forces the shoulder portion 28 further in and down against the support form 49. The result of the further forming step shown in FIG. 12 is the further intermediate product illustrated in FIGS. 5 and 13. At this stage the pleats 32 still exist as pleats partially folded over due to the earlier action of the prism 54 and the folding action of the shoulder forming block 62. Although the shoulder portion 28 is substantially formed, the neck portion 29 is not yet fully formed.

As the shoulder forming block 62 descends on the FIG. 4 product, an inboard ring portion 71 contacts the neck portion 32*n* of this FIG. 4 intermediate product. Because of the curved leading edge of this ring portion 71, the neck pleats 32*n* are cammed inward and the shoulder forming block 62 can proceed downward without damaging the product. However, because of the initial folding caused by the prism 54, this pushing inward of the neck by the ring 71 tends to cause some additional folding. Furthermore, as the shoulder forming block 62 contacts the shoulder pleats 32*s*, the shoulder portion is further folded over which, in turn, further folds over the neck 32*n* pleats into a more substantially folded over position much as is shown in FIG. 5. It has been noted that as the shoulder forming block 62 descends, it tends to twist in a clockwise direction looking downward which is the direction in which the pleats 32 fold over. Presumably, this block 62 is twisted slightly in this clockwise direction because of the folding over in a clockwise direction of the pleats 32. Thus, after the completion of the shoulder forming block 62 operation, the head is substantially formed.

Figure 15:
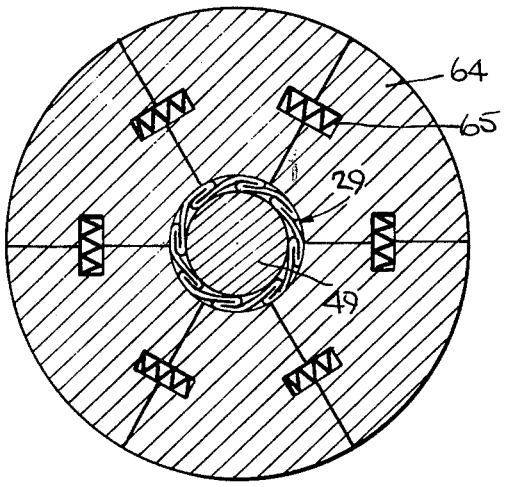
FIG. 15 is a cross-sectional view similar to that of FIG. 13 along the line 15—15 of FIG. 14 illustrating the top of the neck in the configuration shown in FIG. 6 and produced by the FIG. 14 step of manufacture.

However, to assure that the neck 32n pleats are tightly formed and compressed into the minimum thickness possible, the truncated pie-shaped blocks 64 are moved radially inward to create the FIG. 15 condition, also shown in FIG. 6. At the FIG. 12 stage, a cross sectional view through the neck will show the arrangement illustrated in FIG. 13. As shown therein, a number of truncated pie shaped elements 64 are spaced from the neck portion 32n of the pleats 32. These elements 64 are held circumferentially spaced from one another by spring elements 65.

The final forming step of this invention involves bringing these pie shaped elements 64 radially inward to the condition shown in FIG. 15 at which stage the leading edges of these elements 64 have contacted the neck pleats 32n and completed the clockwise folding over of the pleats 32n into a tightly formed neck 29. As may best be seen in FIG. 14, this final folding operation is generated by moving the shaft 66 down against return spring 67 pressure to thereby move the associated block 68 down within the space defined by the shoulder forming block 62. As the block 68 moves downward, sloping downwardly facing surfaces of the block 68 abut against sloping upwardly facing surfaces of each of the pie shaped elements 64 to force these pie elements 64 radially inward to the positions shown in FIGS. 14 and 15. The result is the intermediate product shown in FIG. 6.

This FIG. 6 intermediate product can then be placed in a mold structure and the polyethylene head 24 molded thereon. At that stage, the folded over pleat portions 32s form the impermeable shoulder liner 28 and the folded over pleat portions 32n form the impermeable neck liner 29.

In order for the head 24 when molded to have a smooth transition with the sidewall 22, the shoulder liner portion 28 should have the re-entrant edge 70 as shown in FIG. 2. To assure this re-entrant edge, the shoulder forming block 62 has the shallow hook shaped portion 71. This hook shaped portion forms the re-entrant edge 70 as the machine 60 is brought vertically downward to the position shown in FIG. 12.

The concavity of the crease 34 at the junction between the shoulder portion 32s and the neck portion 32n aids in assuring that there will be a distinction between shoulder and neck in the final product. The neck 29 extends straight up from the shoulder 28 which slopes in at an angle of less than 45° from the horizontal.

Thus the prism 54 serves a dual related function. It pushes over the pleats 32 to start them in the direction in which they will eventually fold and thus assure that each pleat 32 will fold in the same direction (clockwise as seen from the top of the embodiment shown). This prism 54 in addition by virtue of the horizontal edge 55 creates the crease 34 in the pleats 32 that aids in defining the boundry between neck 29 and shoulder 28 and also aids in assuring that there will be a distinct predetermined demarcation between neck 29 and shoulder 28 in the end product.

In one embodiment, the crimping arm 40 is a ⅛th inch thick plate having slightly rounded edges 56, 57 to keep the edges from cutting the tube material.

What is claimed is:

1. Apparatus for manufacturing a collapsible squeeze tube comprising:

a form adapted to hold and position a collapsible cylinder such that one end of the cylinder extends free of said form, pleating means to form a plurality of pleats at the free end of whatever cylinder is held by said form, each of said pleats having a shoulder portion and a neck portion, said shoulder portion being intermediate between said neck portion and the uncrimped cylinderical body portion, creasing means to crease the same side of each of said pleats with a transverse crease at approximately the line between said shoulder portion and said neck portion, and biasing means to partially fold over at least the neck portion of each of said pleats in the same circumferential direction.

2. The apparatus of claim 1 wherein said pleating means comprises:

a plurality of arms circumferentially arraigned and each swingable in a vertical place, each of said arms having a leading edge with a first portion to form said neck portion and a second portion to form said shoulder portion.

3. The apparatus of claim 2 wherein said creasing and biasing means comprise:

a plurality of wedges, one of said wedges on a surface of each of said swingable arms, the apex of each of said wedges being adjacent said neck forming portion of said leading edge of the associated arm, a face surface of each of said wedges extending back from said leading edge and up from said surface of the associated arm to provide a wedge surface that tends to partially fold over at least the neck portion of whatever pleat is formed by said leading edge of the associated arm, and an edge of said face surface of said wedge being positioned between said neck forming portion and said shoulder forming portion of the associated arm to provide the transverse crease of the pleat formed by the associated arm.

4. The apparatus of claim 1 further comprising:

a forming and folding station spaced from said pleating, creasing and biasing means, said form being adapted to move from said pleating, creasing and biasing means to said forming and folding station, forming block means at said folding station to form a re-entrant edge around the outer periphery of said shoulder portion, and folding block means at said folding station to complete the folding of each of said pleats in said same circumferential direction.

5. The apparatus of claim 4 wherein:

said forming block means has an inboard annular ring, said ring having a downwardly facing shallow hook portion, said forming block being mounted for reciprocal vertical movement between a retracted up position and an advanced down position, said hook portion when in said advanced position forming said re-entrant edge of the shoulder portion of the tube being formed.

6. The apparatus of claim 5 wherein said folding block means includes:

a plurality of trucated pie shaped elements circumferentially spaced around the neck portion of said pleats when said forming block is in said advanced position, said elements being movable between a radially outboard position and a radially inboard position, and actuator means responsive to said movement of said forming block to move said elements to said inboard position when said forming block in in said advanced position and to move said elements to said outboard position when said forming block is in said retracted position.

* * * * *